US008840834B2

(12) United States Patent
Matsuda et al.

(10) Patent No.: US 8,840,834 B2
(45) **Date of Patent: *Sep. 23, 2014**

(54) HIGH-STRENGTH STEEL SHEET AND METHOD FOR MANUFACTURING THE SAME

(75) Inventors: Hiroshi Matsuda, Chiba (JP); Reiko Mizuno, Kanagawa (JP); Yoshimasa Funakawa, Kanagawa (JP); Yasushi Tanaka, Tokyo (JP)

(73) Assignee: JFE Steel Coporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/865,542

(22) PCT Filed: Jan. 29, 2009

(86) PCT No.: PCT/JP2009/051914

§ 371 (c)(1),
(2), (4) Date: Oct. 25, 2010

(87) PCT Pub. No.: WO2009/096595

PCT Pub. Date: Aug. 6, 2009

(65) Prior Publication Data

US 2011/0048589 A1 Mar. 3, 2011

(30) Foreign Application Priority Data

Jan. 31, 2008 (JP) ..... 2008-021419

(51) Int. Cl.
*C22C 38/04* (2006.01)
*C21D 8/02* (2006.01)
*C22C 38/14* (2006.01)

(52) U.S. Cl.
USPC ..... 420/8; 148/645; 148/330; 148/333; 148/336; 148/337

(58) Field of Classification Search
CPC ..... C21D 1/18; C21D 8/04; C22C 38/001; C22C 38/04; C22C 38/06; C22C 38/02; C23C 2/28; C23C 2/02; C23C 2/06
USPC ..... 148/645, 330, 333, 336, 337, 320
See application file for complete search history.

(56) References Cited

U.S. PATENT DOCUMENTS 6,114,656 A * 9/2000 Fairchild ..... 219/137 WM (Continued)

FOREIGN PATENT DOCUMENTS

| | | |
|---|---|---|
| EP | 1 764 423 | 3/2007 |
| JP | 6-093340 A | 4/1994 |
| JP | 6-108152 A | 4/1994 |
| JP | 7-090488 A | 4/1995 |
| JP | 07-197183 | 8/1995 |
| JP | 8-026401 B | 3/1996 |
| JP | 2528387 B2 | 8/1996 |

(Continued)

OTHER PUBLICATIONS

Supplementary European Search Report dated Nov. 22, 2013.

*Primary Examiner* — Rebecca Lee
(74) *Attorney, Agent, or Firm* — DLA Piper LLP (US)

(57) ABSTRACT

An ultra-high strength steel sheet has a tensile strength of 1400 MPa or higher that can achieve both high strength and good formability and an advantageous method for manufacturing the steel sheet and includes a composition including, on a mass basis C: 0.12% or more and 0.50% or less; Si: 2.0% or less; Mn: 1.0% or more and 5.0% or less; P: 0.1% or less; S: 0.07% or less; Al: 1.0% or less; and N: 0.008% or less, with the balance Fe and incidental impurities. The steel microstructure includes, on an area ratio basis, 80% or more of autotempered martensite, less than 5% of ferrite, 10% or less of bainite, and 5% or less of retained austenite; and the mean number of precipitated iron-based carbide grains each having a size of 5 nm or more and 0.5 μm or less and included in the autotempered martensite is $5\times10^4$ or more per 1 $mm^2$.

18 Claims, 2 Drawing Sheets

(56) References Cited

U.S. PATENT DOCUMENTS

| | | | | |
|---|---|---|---|---|
| 2004/0202889 | A1* | 10/2004 | Fujita et al. | 428/659 |
| 2005/0173028 | A1* | 8/2005 | Suda et al. | 148/333 |
| 2006/0137768 | A1* | 6/2006 | Yuse et al. | 148/320 |
| 2008/0283158 | A1* | 11/2008 | Nagao et al. | 148/547 |

FOREIGN PATENT DOCUMENTS

| | | | | |
|---|---|---|---|---|
| JP | 2826058 | B2 | 11/1998 | |
| JP | 2002-302734 | | 10/2002 | |
| JP | 2006-183140 | | 7/2006 | |
| WO | WO 2006004228 | A1 * | 1/2006 | C21D 8/02 |

* cited by examiner

HIGH-STRENGTH STEEL SHEET AND METHOD FOR MANUFACTURING THE SAME

RELATED APPLICATIONS

This is a §371 of International Application No. PCT/JP2009/051914, with an international filing date of Jan. 29, 2009 (WO 2009/096595 A1, published Aug. 6, 2009), which is based on Japanese Patent Application Nos. 2008-021419, filed Jan. 31, 2008, and 2009-015823, filed Jan. 27, 2009, the subject matter of which is incorporated by reference.

TECHNICAL FIELD

This disclosure relates to a high strength steel sheet that is used in industrial fields such as the automobile and electrical industries, has good formability, and has a tensile strength of 1400 MPa or higher and a method for manufacturing the same. The high strength steel sheet includes steel sheets whose surface is galvanized or galvannealed.

BACKGROUND

In recent years, the improvement in the fuel efficiency of automobiles has been an important subject from the viewpoint of global environmental conservation. Therefore, by employing a high strength automobile material, there has been an active move to reduce the thickness of components and thus to lighten the automobile body itself. However, since an increase in the strength of steel sheets reduces workability, the development of materials having both high strength and good workability has been demanded. To satisfy such a demand, various multiple-phase steel sheets such as a ferrite-martensite dual-phase steel (DP steel) and a TRIP steel that uses transformation-induced plasticity of retained austenite have been developed.

Furthermore, in recent years, a high strength steel sheet having a tensile strength of more than 1400 MPa has been considered to be utilized and the development has been in progress.

For example, JP 2528387 discloses an ultra-high strength cold-rolled steel sheet having a tensile strength of more than 1500 MPa that has good formability and sheet shape by performing annealing under certain conditions, performing rapid cooling to room temperature with spray water, and performing overaging treatment. JP 8-26401 discloses an ultra-high strength cold-rolled steel sheet having a tensile strength of more than 1500 MPa that has good workability and impact properties by performing annealing under certain conditions, performing rapid cooling to room temperature with spray water, and performing overaging treatment. JP 2826058 discloses a high strength thin steel sheet that has a tensile strength of 980 MPa or higher and whose hydrogen embrittlement is prevented by forming a steel microstructure including 70% or more of martensite on a volume basis and limiting the number of Fe—C precipitates each having a certain size or larger.

However, the above disclosures pose the problems below.

In JP 2528387 and JP 8-26401, ductility and bendability are considered, but stretch-flangeability is not considered. Furthermore, there is another problem in that since a steel sheet needs to be rapidly cooled to room temperature with spray water after annealing, manufacturing cannot be performed without a line having special equipment that can rapidly cool a steel sheet and that is installed between an annealing furnace and an overaging furnace. In JP 2826058, only the hydrogen embrittlement of a steel sheet is improved. Except for a slight consideration for bendability, workability is not sufficiently considered.

In general, to increase the strength of a steel sheet, the ratio of a hard phase to the entire microstructure needs to be increased. In particular when a tensile strength of more than 1400 MPa is achieved, the ratio of a hard phase needs to be increased considerably. Therefore, the workability of a steel sheet is dominated by the workability of a hard phase. In other words, when the ratio of a hard phase is low, minimum workability is ensured due to the deformation of ferrite even if the workability of the hard phase is insufficient. However, when the ratio of a hard phase is high, the deformability itself of the hard phase directly affects the formability of a steel sheet because the deformation of ferrite is not expected. Thus, in the case where the workability of a hard phase is not sufficient, the formability of a steel sheet is considerably degraded.

Therefore, in the case of a cold-rolled steel sheet, as described above, martensite is, for example, formed by performing water quenching in a continuous annealing furnace that can perform water quenching, and the martensite is then tempered through reheating, whereby the workability of the hard phase is improved.

However, in the case where a furnace has no ability to temper the thus-formed martensite through reheating, the strength can be ensured, but it is difficult to ensure the workability of the hard phase such as martensite.

By using bainite and pearlite as a hard phase other than martensite, the workability of a hard phase is ensured and the stretch-flangeability of a cold-rolled steel sheet is improved. However, bainite and pearlite do not necessarily provide satisfactory workability and sometimes cause a problem about the stability of characteristics such as strength.

In particular when bainite is used, there is a problem in that ductility and stretch-flangeability significantly vary due to the variation in the formation temperature of bainite and the holding time.

Furthermore, to ensure ductility and stretch-flangeability, a mixed microstructure of martensite and bainite is considered.

However, to employ a mixed microstructure composed of various phases as a hard phase and precisely control the fraction, the heat treatment conditions need to be strictly controlled, which poses a problem of manufacturing stability. It could therefore be helpful to provide an ultra-high strength steel sheet having a tensile strength of 1400 MPa or higher that can achieve both high strength and good formability and an advantageous method for manufacturing the steel sheet.

SUMMARY

Formability is evaluated using TS×T. El and a λ value that indicates stretch-flangeability. TS×T. El≥14500 MPa·% and λ≥15% are target characteristics.

We studied the formation process of martensite, in particular, the effect of the cooling conditions of a steel sheet on martensite. We subsequently found that a high strength steel sheet having both good formability and high strength with a tensile strength of 1400 MPa or higher that can be obtained by suitably controlling the heat treatment conditions after cold-rolling to cause martensite transformation while at the same time tempering the transformed martensite and then controlling the ratio of the thus-formed autotempered martensite to a certain ratio.

We thus provide:

1. A high strength steel sheet having a tensile strength of 1400 MPa or higher, includes a composition including, on a mass basis:
   C: 0.12% or more and 0.50% or less;
   Si: 2.0% or less;
   Mn: 1.0% or more and 5.0% or less;
   P: 0.1% or less;
   S: 0.07% or less;
   Al: 1.0% or less; and
   N: 0.008% or less, with the balance Fe and incidental impurities, wherein a steel microstructure includes, on an area ratio basis, 80% or more of autotempered martensite, less than 5% of ferrite, 10% or less of bainite, and 5% or less of retained austenite; and the mean number of precipitated iron-based carbide grains each having a size of 5 nm or more and 0.5 μm or less and included in the autotempered martensite is $5\times10^4$ or more per 1 $mm^2$.
2. The high strength steel sheet according to the above-described 1, further includes, on a mass basis, at least one element selected from:
   Cr: 0.05% or more and 5.0% or less;
   V: 0.005% or more and 1.0% or less; and
   Mo: 0.005% or more and 0.5% or less.
3. The high strength steel sheet according to the above-described 1 or 2, further includes, on a mass basis, at least one element selected from:
   Ti: 0.01% or more and 0.1% or less;
   Nb: 0.01% or more and 0.1% or less;
   B: 0.0003% or more and 0.0050% or less;
   Ni: 0.05% or more and 2.0% or less; and
   Cu: 0.05% or more and 2.0% or less.
4. The high strength steel sheet according to any one of the above-described 1 to 3, further includes, on a mass basis, at least one element selected from:
   Ca: 0.001% or more and 0.005% or less; and
   REM: 0.001% or more and 0.005% or less.
5. The high strength steel sheet according to any one of the above-described 1 to 4, wherein the area ratio of autotempered martensite in which the number of precipitated iron-based carbide grains each having a size of 0.1 μm or more and 0.5 μm or less is $5\times10^2$ or less per 1 $mm^2$ to the entire autotempered martensite is 3% or more.
6. The high strength steel sheet according to any one of the above-described 1 to 5, wherein a galvanized layer is disposed on a surface of the steel sheet.
7. The high strength steel sheet according to any one of the above-described 1 to 5, wherein a galvannealed layer is disposed on a surface of the steel sheet.
8. A method for manufacturing a high strength steel sheet, includes the steps of hot-rolling and then cold-rolling a slab to be formed into a steel sheet having the composition according to any one of the above-described 1 to 4 to form a cold-rolled steel sheet; annealing the cold-rolled steel sheet in a first temperature range of $A_{C3}$ transformation temperature or higher and 1000° C. or lower for 15 seconds or longer and 600 seconds or shorter; cooling the steel sheet from the first temperature range to 780° C. at an average cooling rate of 3° C./s or higher; cooling the steel sheet in a second temperature range of 780° C. to 550° C. at an average cooling rate of 10° C./s or higher; and cooling the steel sheet in a third temperature range of at least Ms temperature to 150° C. at a cooling rate of 0.01° C./s or higher and 10° C./s or lower when the Ms temperature is less than 300° C. or cooling the steel sheet from Ms temperature to 300° C. at a cooling rate of 0.5° C./s or higher and 10° C./s or lower and from 300° C. to 150° C. at a cooling rate of 0.01° C./s or higher and 10° C./s or lower when the Ms temperature is 300° C. or higher, to perform, in the third temperature range, autotempering treatment in which martensite is formed while at the same time transformed martensite is tempered.
9. The method for manufacturing a high strength steel sheet according to the above-described 8, wherein the steel sheet that has been subjected to cooling in the second temperature range is cooled in the third temperature range of at least Ms temperature to 150° C. at a cooling rate of 1.0° C./s or higher and 10° C./s or lower when the Ms temperature is less than 300° C. or is cooled from Ms temperature to 300° C. at a cooling rate of 0.5° C./s or higher and 10° C./s or lower and from 300° C. to 150° C. at a cooling rate of 1.0° C./s or higher and 10° C./s or lower when the Ms temperature is 300° C. or higher, to perform, in the third temperature range, autotempering treatment in which martensite is formed while at the same time transformed martensite is tempered.

An ultra-high strength steel sheet having a tensile strength of 1400 MPa or higher that has both good workability and high strength can be obtained by forming an appropriate amount of autotempered martensite in a steel sheet. Therefore, our steel sheets significantly contribute to the weight reduction of automobile bodies.

In the method for manufacturing a high strength steel sheet, since the reheating of a steel sheet after quenching is not needed, special manufacturing equipment is not required and the method can be easily applied to a galvanizing or galvannealing process. Therefore, the method contributes to decreases in the number of steps and in the cost.

DETAILED DESCRIPTION

Figure 1:
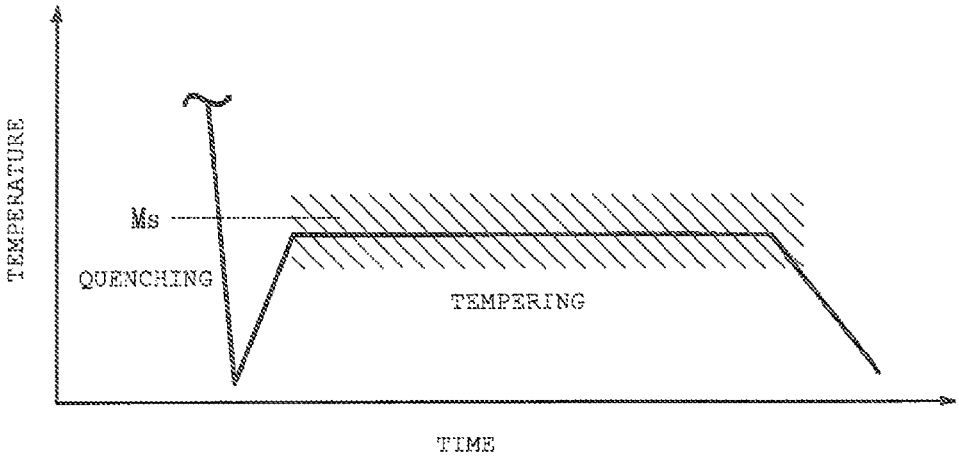
FIG. 1 is a schematic view showing quenching and tempering steps performed to obtain typical tempered martensite.

Our steel sheets and methods will now be specifically described.

The reason for the above-described limitation of the microstructure of a steel sheet will be described below.

Area ratio of autotempered martensite: 80% or more

Autotempered martensite is a microstructure obtained by simultaneously causing martensite transformation and the tempering of the martensite through autotempering treatment, and not so-called "tempered" martensite obtained through quenching and tempering treatments as in the related art. The microstructure is not a uniformly tempered microstructure formed by completing martensite transformation through quenching and then performing tempering through a temperature increase as in typical quenching and tempering treatments, but is a microstructure including martensites in different tempered states obtained by performing martensite transformation and tempering of the martensite in stages through the control of a cooling process in a temperature range of Ms temperature or lower.

Autotempered martensite is a hard phase that contributes to an increase in the strength of a steel sheet. Thus, to achieve high strength with a tensile strength of 1400 MPa or higher, the area ratio of autotempered martensite needs to be 80% or more. Since autotempered martensite not only functions as a hard phase but also has good workability, desired workability can be ensured even if the area ratio is 100%.

The steel microstructure is preferably composed of the above-described autotempered martensite. Other phases such as ferrite, bainite, and retained austenite are sometimes formed. These phases may be formed as long as some parameters are within the tolerable ranges described below.

Area ratio of ferrite: less than 5% (including 0%)

Ferrite is a soft microstructure. If ferrite is added to a steel microstructure having 80% or more of autotempered martensite, which is a steel sheet of the present invention, such that the area ratio of ferrite is 5% or more, it may be difficult to ensure a tensile strength of 1400 MPa or higher and preferably 1470 MPa or higher depending on the distribution of ferrite. Thus, the area ratio of ferrite is specified to less than 5%.

Area ratio of bainite: 10% or less (including 0%)

Bainite is a hard phase that contributes to an increase in strength and therefore may be included in the steel microstructure together with autotempered martensite. However, the characteristics of bainite significantly vary in accordance with the formation temperature range and the variation in the quality of material tends to be increased. Therefore, the area ratio of bainite needs to be 10% or less and is preferably 5% or less.

Area ratio of retained austenite: 5% or less (including 0%)

Retained austenite is transformed into hard martensite when processed, which decreases stretch-flangeability. Thus, the area ratio of retained austenite in a steel microstructure is desirably as low as possible, but up to 5% of retained austenite is tolerable. The area ratio of retained austenite is preferably 3% or less.

Iron-Based Carbide in Autotempered Martensite

Size: 5 nm or more and 0.5 μm or less, Mean number of precipitated carbide grains: $5\times10^4$ or more per 1 $mm^2$ Autotempered martensite is martensite subjected to the heat treatment (autotempering treatment) performed by our method. However, the workability is decreased when the autotempering treatment is improperly performed. The degree of autotempering treatment can be confirmed through the formation state (distribution state) of iron-based carbide grains in autotempered martensite. When the mean number of precipitated iron-based carbide grains each having a size of 5 nm or more and 0.5 μm or less is $5\times10^4$ or more per 1 $mm^2$, it can be judged that desired autotempering treatment has been performed. Iron-based carbide grains each having a size of less than 5 nm are removed from the target of judgment because such carbide grains do not affect the workability of autotempered martensite. On the other hand, iron-based carbide grains each having a size of more than 0.5 μm are also removed from the target of judgment because such carbide grains may decrease the strength of autotempered martensite but hardly affect the workability. If the number of iron-based carbide grains is less than $5\times10^4$ per 1 $mm^2$, it is judged that the autotempering treatment has been improperly performed because workability, particularly stretch-flangeability, is not improved. The number of iron-based carbide grains is preferably $1\times10^5$ or more and $1\times10^6$ or less per 1 $mm^2$, more preferably $4\times10^5$ or more and $1\times10^6$ or less per 1 $mm^2$. Herein, an iron-based carbide is mainly $Fe_3C$, and ϵ carbides and the like may be further contained.

To confirm the formation state of carbide grains, it is effective to observe a mirror-polished sample using a SEM (scanning electron microscope) or a TEM (transmission electron microscope). Carbide grains can be identified by, for example, performing SEM-EDS (energy dispersive X-ray spectrometry), EPMA (electron probe microanalyzer), or FE-AES (field emission-Auger electron spectrometry) on samples whose section is polished.

The amount of autotempered martensite narrowed down by further limiting the size and number of iron-based carbide grains precipitated in the above-described autotempered martensite can be suitably set as follows.

Autotempered martensite in which the number of precipitated iron-based carbide grains each having a size of 0.1 μm or more and 0.5 μM or less is $5\times10^2$ or less per 1 $mm^2$: the area ratio of the autotempered martensite to the entire autotempered martensite is 3% or more By increasing the ratio of autotempered martensite in which the number of precipitated iron-based carbide grains each having a size of 0.1 μm or more and 0.5 μm or less is $5\times10^2$ or less per 1 $mm^2$, ductility can be further improved without degrading stretch-flangeability. To produce such an effect, the area ratio of autotempered martensite in which the number of precipitated iron-based carbide grains each having a size of 0.1 μm or more and 0.5 μm or less is $5\times10^2$ or less per 1 $mm^2$ to the entire autotempered martensite is preferably 3% or more. If a large amount of autotempered martensite in which the number of precipitated iron-based carbide grains each having a size of 0.1 μm or more and 0.5 μm or less is $5\times10^2$ or less per 1 $mm^2$ is contained in a steel sheet, workability is considerably degraded. Thus, the area ratio of such autotempered martensite to the entire autotempered martensite is preferably 40% or less, more preferably 30% or less.

When the area ratio of autotempered martensite in which the number of precipitated iron-based carbide grains each having a size of 0.1 μm or more and 0.5 μm or less is $5\times10^2$ or less per 1 $mm^2$ to the entire autotempered martensite is 3% or more, the number of fine iron-based carbide grains is increased in autotempered martensite. Therefore, the mean number of precipitated iron-based carbide grains in the entire autotempered martensite is increased. Thus, the mean number of precipitated iron-based carbide grains each having a size of 5 nm or more and 0.5 μm or less in autotempered martensite is preferably $1\times10^5$ or more and $5\times10^6$ or less per 1 $mm^2$, more preferably $4\times10^5$ or more and $5\times10^6$ or less per 1 $mm^2$.

The specific reason why ductility is further improved without degrading stretch-flangeability as described above is not clear, but it is believed to be as follows. When the area ratio of autotempered martensite in which the number of precipitated iron-based carbide grains each having a relatively large size of 0.1 μm or more and 0.5 μm or less is $5\times10^2$ or less per 1 $mm^2$ to the entire autotempered martensite is 3% or more, the autotempered martensite microstructure includes a portion that contains a large number of iron-based carbide grains having a relatively large size and a portion that contains a small number of iron-based carbide grains having a relatively large size in a mixed manner. The portion that contains a small number of iron-based carbide grains having a relatively large size is hard autotempered martensite because a large number of fine iron-based carbide grains are contained. On the other hand, the portion that contains a large number of iron-based carbide grains having a relatively large size is soft autotempered martensite. By providing the hard autotempered martensite such that the hard autotempered martensite is surrounded by the soft autotempered martensite, the degradation of stretch-flangeability caused by the hardness difference in autotempered martensite can be suppressed. Furthermore, by dispersing the hard martensite in the soft autotempered martensite, work hardenability is improved and thus ductility is improved.

The reason why the composition is set in the above-described range in the steel sheet will be described below. The symbol "%" below used for each component means "% by mass".

C: 0.12% or more and 0.50% or less

C is an essential element for increasing the strength of a steel sheet. A C content of less than 0.12% causes difficulty in achieving both strength and workability such as ductility or stretch-flangeability of the steel sheet. On the other hand, a C content of more than 0.50% causes a significant hardening of welds and heat-affected zones, thereby reducing weldability. Thus, the C content is set in the range of 0.12% or more and 0.50% or less, preferably 0.14% or more and 0.23% or less.

Si: 2.0% or less

Si is a useful element for controlling the precipitation state of iron-based carbides, and the Si content is preferably 0.1% or more. However, the excessive addition of Si causes the degradation of surface quality due to the occurrence of red scale and the like and the degradation of the adhesion of a coating. Thus, the Si content is set to 2.0% or less, preferably 1.6% or less.

Mn: 1.0% or more and 5.0% or less

Mn is an element that is effective in strengthening steel, stabilizes austenite, and is necessary for ensuring a desired amount of hard phase. To achieve this, a Mn content of 1.0% or more is required. On the other hand, an excessive Mn content of more than 5.0% causes the degradation of castability or the like. Thus, the Mn content is set in the range of 1.0% or more and 5.0% or less, preferably 1.5% or more and 4.0% or less.

P: 0.1% or less

P causes embrittlement due to grain boundary segregation and degrades shock resistance, but a P content of up to 0.1% is tolerable. Furthermore, in the case where a steel sheet is galvannealed, a P content of more than 0.1% significantly reduces the rate of alloying. Thus, the P content is set to 0.1% or less, preferably 0.05% or less.

S: 0.07% or less

S is formed into MnS as an inclusion that causes the degradation of shock resistance and also causes cracks along a flow of a metal in a weld zone. Thus, the S content is preferably minimized. However, a S content of up to 0.07% is tolerable in terms of manufacturing costs. The S content is preferably 0.04% or less.

Al: 1.0% or less

Al is an element that contributes to ferrite formation and a useful element for controlling the amount of the ferrite formation during manufacturing. However, an excessive Al content degrades the quality of a slab during steelmaking. Thus, the Al content is set to 1.0% or less, preferably 0.5% or less. Since an excessively low Al content sometimes makes it difficult to perform deoxidization, the Al content is preferably 0.01% or more.

N: 0.008% or less

N is an element that considerably degrades the anti-aging property of steel. Therefore, the N content is preferably minimized. A N content of more than 0.008% causes significant degradation of an anti-aging property. Thus, the N content is set to 0.008% or less, preferably 0.006% or less.

If necessary, the components described below can be suitably contained in addition to the basic components described above.

At least one element selected from Cr: 0.05% or more and 5.0% or less, V: 0.005% or more and 1.0% or less, and Mo: 0.005% or more and 0.5% or less Cr, V, and Mo have an effect of suppressing the formation of pearlite when a steel sheet is cooled from the annealing temperature and thus can be optionally contained. The effect is produced at a Cr content of 0.05% or more, a V content of 0.005% or more, or a Mo content of 0.005% or more. On the other hand, an excessive Cr content of more than 5.0%, an excessive V content of more than 1.0%, or an excessive Mo content of more than 0.5% degrades the workability due to the development of a band microstructure or the like. Thus, when these elements are incorporated, the Cr content is preferably set in the range of 0.05% or more and 5.0% or less, the V content is preferably set in the range of 0.005% or more and 1.0% or less, and the Mo content is preferably set in the range of 0.005% or more and 0.5% or less.

Furthermore, at least one element selected from Ti, Nb, B, Ni, and Cu can be incorporated. The reason for the limitation of the content ranges is as follows.

Ti: 0.01% or more and 0.1% or less and Nb: 0.01% or more and 0.1% or less

Ti and Nb are useful for precipitation strengthening of steel and the effect is produced at a Ti content of 0.01% or more or a Nb content of 0.01% or more. On the other hand, a Ti content of more than 0.1% or a Nb content of more than 0.1% degrades the workability and shape flexibility. Thus, the Ti content and the Nb content are each preferably set in the range of 0.01% or more and 0.1% or less.

B: 0.0003% or more and 0.0050% or less

B has an effect of suppressing the formation and growth of ferrite from austenite grain boundaries and thus can be optionally added. The effect is produced at a B content of 0.0003% or more. On the other hand, a B content of more than 0.0050% decreases workability. Thus, when B is incorporated, the B content is set in the range of 0.0003% or more and 0.0050% or less. Herein, when B is incorporated, the formation of BN is preferably suppressed to produce the above-described effect. Thus, B is preferably added together with Ti.

Ni: 0.05% or more and 2.0% or less and Cu: 0.05% or more and 2.0% or less

In the case where a steel sheet is galvanized, Ni and Cu promote internal oxidation, thereby improving the adhesion of a coating. Ni and Cu are useful elements for strengthening steel. These effects are produced at a Ni content of 0.05% or more or a Cu content of 0.05% or more. On the other hand, a Ni content of more than 2.0% or a Cu content of more than 2.0% degrades the workability of a steel sheet. Thus, the Ni content and the Cu content are each preferably set in the range of 0.05% or more and 2.0% or less.

At least one element selected from Ca: 0.001% or more and 0.005% or less and REM: 0.001% or more and 0.005% or less.

Ca and REM are useful elements for spheroidizing the shape of a sulfide and improving an adverse effect of the sulfide on stretch-flangeability. The effect is produced at a Ca content of 0.001% or more or an REM content of 0.001% or more. On the other hand, a Ca content of more than 0.005% or an REM content of more than 0.005% increases the number of inclusions or the like and causes, for example, surface defects and internal defects. Thus, when Ca and REM are incorporated, the Ca content and the REM content are each preferably set in the range of 0.001% or more and 0.005% or less.

Components other than the components described above are Fe and incidental impurities. However, a component other than the components described above may be contained to the extent that the advantages are not impaired.

A galvanized layer or a galvannealed layer may be disposed on a surface of the steel sheet.

A preferred method for manufacturing a steel sheet and the reason for the limitation of the manufacturing conditions will now be described.

A slab prepared to have the above-described preferred composition is produced, hot-rolled, and then cold-rolled to obtain a cold-rolled steel sheet. In the method for manufacturing our steel sheets, these processes are not particularly limited, and can be performed by typical methods.

The preferred manufacturing conditions will now be described below. A slab is heated to 1100° C. or higher and 1300° C. or lower and subjected to finish hot-rolling at a temperature of 870° C. or higher and 950° C. or lower, which means that the hot-rolling end temperature is set to 870° C. or higher and 950° C. or lower. The thus-obtained hot-rolled steel sheet is wound at a temperature of 350° C. or higher and 720° C. or lower. Subsequently, the hot-rolled steel sheet is pickled and cold-rolled at a reduction ratio of 40% or higher and 90% or lower to obtain a cold-rolled steel sheet.

It is assumed that the hot-rolled steel sheet is produced through the typical steps of steel making, casting, and hot-rolling, but the hot-rolled steel sheet can be produced by thin slab casting without performing part or all of the hot-rolling steps.

The thus-obtained cold-rolled steel sheet is annealed for 15 seconds or longer and 600 seconds or shorter in a first temperature range of $A_{C3}$ transformation temperature or higher and 1000° C. or lower, specifically, in an austenite single-phase region. If the annealing temperature is lower than $A_{C3}$ transformation temperature, ferrite is formed during the annealing and it may be difficult to suppress the growth of ferrite even if the cooling rate to 550° C., which is a ferrite growth region, is increased. On the other hand, if the annealing temperature exceeds 1000° C., austenite grains are significantly grown and thus the formations of ferrite, pearlite, and bainite are suppressed except for the formation of autotempered martensite. However, this may degrade the toughness. If the annealing time is shorter than 15 seconds, a carbide in the cold-rolled steel sheet is sometimes not sufficiently dissolved. If the annealing time exceeds 600 seconds, a vast amount of energy is consumed and thus the cost is increased. Therefore, the annealing temperature is set in the range of $A_{C3}$ transformation temperature or higher and 1000° C. or lower, preferably [$A_{c3}$ transformation temperature+10]° C. or higher and 950° C. or lower. The annealing time is set in the range of 15 seconds or longer and 600 seconds or shorter, preferably 30 seconds or longer and 400 seconds or shorter.

Herein, $A_{C3}$ transformation temperature is obtained from the formula below:

$$[A_{C3}\text{ transformation temperature}]\ (^\circ\text{C}) = 910 - 203\times[C\ \%]^{\frac{1}{2}} + 44.7\times[\text{Si}\ \%] - 30\times[\text{Mn}\ \%] + 700\times[\text{P}\ \%] + 400\times[\text{Al}\ \%] - 15.2\times[\text{Ni}\ \%] - 11\times[\text{Cr}\ \%] - 20\times[\text{Cu}\ \%] + 31.5\times[\text{Mo}\ \%] + 104\times[\text{V}\ \%] + 400\times[\text{Ti}\ \%]$$

where [X %] is mass % of a constituent element X of a slab.

The annealed cold-rolled steel sheet is cooled from the first temperature range to 780° C. at an average cooling rate of 3° C./s or higher. The temperature range from the first temperature range to 780° C., that is, from $A_{C3}$ transformation temperature, which is the lower limit temperature of the first temperature range, to 780° C. is a temperature range in which the precipitation of ferrite could be caused although the precipitation rate of ferrite is low compared with in a temperature range of 780° C. or lower described below. Therefore, the steel sheet needs to be cooled from $A_{C3}$ transformation temperature to 780° C. at an average cooling rate of 3° C./s or higher. If the average cooling rate is less than 3° C./s, ferrite is formed and grown, whereby a desired microstructure is sometimes not obtained. The upper limit of the average cooling rate is not particularly specified, but special cooling equipment is required to achieve an average cooling rate of more than 200° C./s and the average cooling rate is preferably 200° C./s or lower. The average cooling rate is preferably set in the range of 5° C./s or higher and 200° C./s or lower.

The cold-rolled steel sheet that has been cooled to 780° C. is then cooled at an average cooling rate of 10° C./s or higher in a second temperature range of 780° C. to 550° C. The temperature range of 780° C. to 550° C. is a temperature range in which the precipitation rate of ferrite is high and thus ferrite transformation is easily caused. If the average cooling rate is less than 10° C./s in that temperature range, ferrite, pearlite, and the like are precipitated, whereby a desired microstructure is sometimes not obtained. The average cooling rate is preferably 15° C./s or higher. When the $A_{C3}$ transformation temperature is 780° C. or lower, the average cooling rate can be set to 10° C./s or higher in the second temperature range of transformation temperature equal to or lower than 780° C. to 550° C.

The cold-rolled steel sheet that has been cooled to 550° C. is subjected to autotempering treatment. Autotempering treatment is a treatment in which, for a steel sheet whose temperature reaches Ms temperature, that is, martensite start temperature, martensite transformation is caused while at the same time the transformed martensite is tempered. The most important feature of the high strength steel sheet is that a steel microstructure includes autotempered martensite.

Typical martensite is obtained by performing annealing and then performing quenching with water cooling or the like. The martensite is an extremely hard phase, and contributes to an increase in the strength of a steel sheet but degrades workability. To change the martensite into tempered martensite having satisfactory workability, a quenched steel sheet is normally heated again to perform tempering. FIG. 1 schematically shows the steps described above. In such normal quenching and tempering treatments, after martensite transformation is completed by quenching, the temperature is increased to perform tempering. Consequently, a uniformly tempered microstructure is obtained.

Figure 2A:
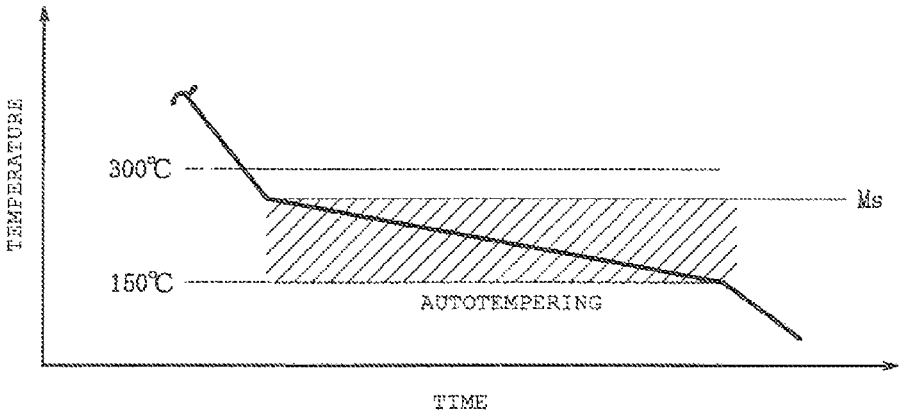
FIG. 2A is a schematic view showing an autotempering treatment step performed to obtain autotempered martensite.
Figure 2B:
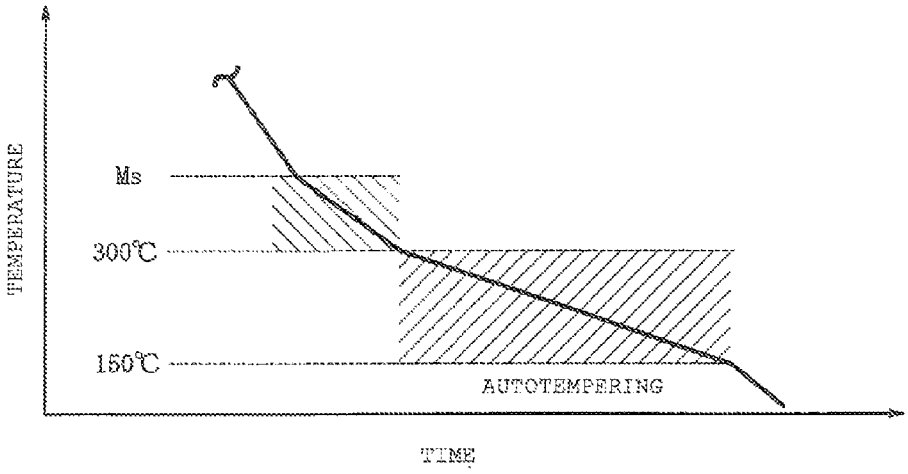
FIG. 2B is a schematic view showing an autotempering treatment step performed to obtain autotempered martensite.

In contrast, in the autotempering treatment, quenching and tempering through reheating are not performed as shown in FIGS. 2A and 2B, which is a method with high productivity. The steel sheet including autotempered martensite obtained through this autotempering treatment has strength and workability equal to or higher than those of the steel sheet obtained by performing quenching and tempering through reheating shown in FIG. 1. In the autotempering treatment, martensite transformation and the tempering can be made to occur continuously or stepwise by performing continuous cooling (including stepwise cooling and holding) in a third temperature range. Consequently, a microstructure including martensites in different tempered states can be obtained. Although the martensites in different tempered states have different characteristics in terms of strength and workability, desired characteristics as the entire steel sheet can be satisfied by suitably controlling the amounts of martensites in different tempered states through autotempering treatment. Furthermore, since the autotempering treatment is performed without rapidly cooling a steel sheet to a low temperature range in which the martensite transformation is fully completed, the residual stress in the steel sheet is low and a steel sheet having a good plate shape is obtained, which is advantageous:

Autotempering treatment will be specifically described below.

When Ms temperature is less than 300° C., as shown in FIG. 2A, a steel sheet is cooled at an average cooling rate of 0.01° C./s or higher and 10° C./s or lower in a third temperature range of at least Ms temperature to 150° C. At a cooling rate of less than 0.01° C./s, autotempering excessively proceeds and carbide grains in the autotempered martensite are significantly coarsened, whereby strength sometimes cannot be ensured. On the other hand, at an average cooling rate of more than 10° C./s, autotempering treatment does not sufficiently proceed, which provides insufficient workability of martensite. The average cooling rate is preferably set in the range of 0.1° C./s or higher and 8° C./s or lower.

When Ms temperature is 300° C. or higher, as shown in FIG. 2B, a steel sheet is cooled at an average cooling rate of 0.5° C./s or higher and 10° C./s or lower in a temperature range of Ms temperature to 300° C. and at an average cooling rate of 0.01° C./s or higher and 10° C./s or lower in a temperature range of 300° C. to 150° C. At an average cooling rate of less than 0.5° C./s in the temperature range of Ms temperature to 300° C., autotempering treatment excessively proceeds and carbide grains in the autotempered martensite are significantly coarsened, whereby strength is sometimes not easily ensured. On the other hand, at an average cooling rate of more than 10° C./s, autotempering treatment does not sufficiently proceed, whereby the workability of martensite cannot be ensured. The average cooling rate is preferably set in the range of 1° C./s or higher and 8° C./s or lower.

At an average cooling rate of less than 0.01° C./s in the temperature range of 300° C. to 150° C., autotempering excessively proceeds and carbide grains in the autotempered martensite are significantly coarsened, whereby strength sometimes cannot be ensured. On the other hand, at a cooling rate of more than 10° C./s, autotempering treatment does not sufficiently proceed, which provides insufficient workability of martensite.

In a temperature range from 550° C., which is the lower limit temperature of the second temperature range, to Ms temperature, which is the upper limit temperature of the third temperature range, the cooling rate of a cold-rolled steel sheet is not particularly limited. The cooling rate is preferably controlled so that pearlite or bainite transformation does not proceed, and thus the cooling rate is preferably set in the range of 0.5° C./s or higher and 200° C./s or lower.

The above-described Ms temperature can be obtained in a typical manner through the measurement of thermal expansion or electrical resistance during cooling. Alternatively, the Ms temperature can be approximately obtained from, for example, Formula (1) below and M is an empirically obtained approximate value:

$$M(^\circ\,\text{C.})=540-361\times\{[\text{C }\%]/(1-[\alpha\%]/100)\}-6\times[\text{Si }\%]-40\times[\text{Mn }\%]+30\times[\text{Al }\%]-20\times[\text{Cr }\%]-35\times[\text{V }\%]-10\times[\text{Mo }\%]-17\times[\text{Ni }\%]-10\times[\text{Cu }\%] \quad (1)$$

where [X %] is mass % of a constituent element X of a slab and [α%] is the area ratio (%) of polygonal ferrite.

The area ratio of polygonal ferrite is measured, for example, through the image processing and analysis of a SEM micrograph taken at 1000 to 3000 power.

When Ms temperature is approximately obtained from Formula (1) above, it is believed that there is a slight difference between the calculated M value and the real Ms temperature. In particular when the Ms temperature is less than 300° C., autotempering treatment slowly proceeds and thus the difference poses a problem. Therefore, when the Ms temperature is less than 300° C. and the M value is used as Ms temperature, the cooling start temperature in the third temperature range is preferably set to the M value+50° C., which is higher than the M value, such that the cooling temperature in the third temperature range of at least Ms temperature to 150° C. can be ensured. On the other hand, when the Ms temperature is 300° C. or higher, autotempering treatment rapidly proceeds and thus the delay of autotempering due to the difference between the M value and the real Ms temperature is low. Conversely, if cooling is performed from high temperature range at the above-described cooling rate, autotempering may excessively proceed. On the basis of Ms temperature calculated from the M value, cooling can be performed from Ms temperature to 300° C. and from 300° C. to 150° C. under the above-described conditions. The Ms temperature calculated from the M value is preferably set to 250° C. or higher to stably obtain autotempered martensite.

Polygonal ferrite is observed in the steel sheet that has been annealed and cooled under the above-described conditions. To satisfy the relationship between the cooling conditions and the Ms temperature calculated from the M, a cold-rolled steel sheet having a desired composition is produced; the area ratio of polygonal ferrite is measured; M is obtained from Formula (1) above using the contents of alloy elements that can be calculated from the composition of the steel sheet; and thus Ms temperature is obtained from the M. In the case where the cooling conditions at a temperature equal to or lower than the Ms temperature obtained from the above-described manufacturing conditions depart from our range, the cooling conditions or the contents of the components are suitably adjusted so that the manufacturing conditions are within our range. In Invention Example, as described above, the residual amount of ferrite is extremely small and the cooling conditions in a temperature range of Ms temperature or lower hardly affect the area ratio of ferrite. Therefore, the change in Ms temperature due to the adjustment of cooling conditions is small.

In the method for manufacturing a steel sheet, the following configuration can be suitably added if necessary.

The cooling is performed at an average cooling rate of 10° C./s or higher in the second temperature range. Subsequently, when Ms temperature is less than 300° C., cooling is performed at a cooling rate of 1.0° C./s or higher and 10° C./s or lower in the third temperature range of at least Ms temperature to 150° C. When Ms temperature is 300° C. or higher, cooling is performed at a cooling rate of 0.5° C./s or higher and 10° C./s or lower from Ms temperature to 300° C. and at a cooling rate of 1.0° C./s or higher and 10° C./s or lower from 300° C. to 150° C. Thus, martensite is formed in the third temperature range while at the same time the transformed martensite is subjected to autotempering treatment, whereby autotempered martensite in which the number of precipitated iron-based carbide grains each having a size of 0.1 μm or more and 0.5 μm or less is $5\times10^2$ or less per 1 $mm^2$ is partly formed in the entire autotempered martensite (3% or more on an area ratio basis). Consequently, ductility can be improved.

The steel sheet can be galvanized and galvannealed.

A method of galvanizing and galvannealing treatments is as follows. First, a steel sheet is immersed in a coating bath and the coating weight is adjusted using gas wiping or the like. In the case where the steel sheet is galvanized, the amount of dissolved Al in the coating bath is in the range of 0.12% or more and 0.22% or less. In the case where the steel sheet is galvannealed, the amount of dissolved Al is in the range of 0.08% or more and 0.18% or less. In the case where the steel sheet is galvanized, the temperature of the coating bath is desirably 450° C. or higher and 500° C. or lower. In the case where the steel sheet is galvannealed by further performing alloying treatment, the temperature during alloying is desirably 450° C. or higher and 550° C. or lower. If the alloying temperature exceeds 550° C., an excessive amount of carbide grains are precipitated from untransformed austenite or the transformation into pearlite is caused, whereby intended strength and ductility are sometimes not achieved. Powdering is also degraded. If the alloying temperature is less than 450° C., the alloying does not proceed.

The coating weight is preferably in the range of 20 to 150 g/m$^2$ per surface. If the coating weight is less than 20 g/m$^2$, corrosion resistance is degraded. Meanwhile, even if the coating weight exceeds 150 g/m$^2$, the effect on corrosion resistance is saturated, which merely increases the cost. The degree of alloying is preferably in the range of about 7 to 15% by mass on a Fe content basis in the coating layer. If the degree of alloying is less than 7% by mass on a Fe content basis, uneven alloying is caused and the surface appearance quality is degraded. Furthermore, a so-called phase "ζ" is formed in the coating layer and thus the slidability is degraded. If the degree of alloying exceeds 15% by mass on a Fe content basis, a large amount of hard brittle Γ phase is formed and the adhesion of the coating is degraded.

The holding temperature in the first temperature range is not necessarily constant. Even if the holding temperature is varied, the purpose of this step is not impaired as long as the holding temperature is within a predetermined temperature range. The same is true for the cooling rate in each of the temperature ranges. Furthermore, a steel sheet may be subjected to annealing and autotempering treatments with any equipment as long as heat history is just satisfied. Moreover, it is also possible that, after autotempering treatment, temper rolling is performed on the steel sheet for shape correction.

EXAMPLES

Example 1

Our steel sheets and methods will now be further described with Examples. This disclosure is not limited to the Examples. It will be understood that modifications may be made without departing from the scope of this disclosure.

A slab to be formed into each of steel sheets having the various compositions shown in Table 1 was heated to 1250° C. and subjected to finish hot-rolling at 880° C. The hot-rolled steel sheet was wound at 600° C., pickled, and cold-rolled at a reduction ratio of 65% to obtain a cold-rolled steel sheet having a thickness of 1.2 mm. The resultant cold-rolled steel sheet was subjected to heat treatment under the conditions shown in Table 2. Quenching was not performed on any sample shown in Table 2.

In the galvanizing treatment, both surfaces were subjected to plating in a coating bath having a temperature of 463° C. at a coating weight of 50 g/m$^2$ per surface. In the galvannealing treatment, the alloying treatment was performed such that Fe amount (Fe content) in the coating layer was adjusted to 9% by mass. The resultant steel sheet was subjected to temper rolling at a reduction ratio (elongation ratio) of 0.3% regardless of the presence or absence of a coating.

TABLE 1

(mass %) (° C.)

| Steel type | C | Si | Mn | Al | P | S | N | Cr | V | Mo | Ti | Nb | B | Ni | Cu | Ca | REM | $Ac_3$ | Remarks |
|---|---|---|---|---|---|---|---|---|---|---|---|---|---|---|---|---|---|---|---|
| A | 0.20 | 1.49 | 2.3 | 0.036 | 0.013 | 0.002 | 0.0041 | — | — | — | — | — | — | — | — | — | — | 840 | Suitable steel |
| B | 0.33 | 1.51 | 2.3 | 0.037 | 0.013 | 0.003 | 0.0037 | — | — | — | — | — | — | — | — | — | — | 816 | Suitable steel |
| C | 0.29 | 1.52 | 2.4 | 0.041 | 0.013 | 0.003 | 0.0038 | — | — | — | — | — | — | — | — | — | — | 822 | Suitable steel |
| D | 0.13 | 1.53 | 2.3 | 0.039 | 0.009 | 0.003 | 0.0036 | — | — | — | — | 0.04 | — | — | — | — | — | 858 | Suitable steel |
| E | 0.16 | 1.23 | 2.3 | 0.039 | 0.025 | 0.003 | 0.0038 | 0.9 | — | — | — | 0.03 | — | — | — | — | — | 838 | Suitable steel |
| F | 0.22 | 1.50 | 2.3 | 0.040 | 0.013 | 0.003 | 0.0032 | 1.0 | — | — | 0.021 | — | 0.0005 | — | — | — | — | 835 | Suitable steel |
| G | 0.19 | 0.50 | 1.6 | 0.044 | 0.012 | 0.005 | 0.0033 | — | — | — | 0.019 | — | 0.0008 | — | — | — | — | 829 | Suitable steel |
| H | 0.23 | 1.40 | 2.2 | 0.038 | 0.009 | 0.003 | 0.0037 | — | 0.2 | — | — | — | — | — | — | — | — | 852 | Suitable steel |
| I | 0.21 | 0.70 | 2.1 | 0.041 | 0.011 | 0.002 | 0.0039 | — | — | 0.1 | — | — | — | — | — | — | — | 813 | Suitable steel |
| J | 0.22 | 1.00 | 1.9 | 0.042 | 0.013 | 0.003 | 0.0042 | — | — | — | — | — | — | 0.4 | 0.2 | — | — | 818 | Suitable steel |
| K | 0.18 | 1.30 | 2.4 | 0.045 | 0.011 | 0.004 | 0.0035 | — | — | — | — | — | — | — | — | 0.002 | — | 836 | Suitable steel |
| L | 0.21 | 1.40 | 2.2 | 0.039 | 0.019 | 0.004 | 0.0041 | — | — | — | — | — | — | — | — | — | 0.002 | 842 | Suitable steel |
| M | 0.11 | 1.50 | 2.3 | 0.037 | 0.009 | 0.003 | 0.0040 | 1.0 | — | — | — | — | — | — | — | — | — | 851 | Comparative steel |
| N | 0.55 | 1.40 | 2.2 | 0.042 | 0.013 | 0.004 | 0.0039 | — | — | — | — | — | — | — | — | — | — | 782 | Comparative steel |
| O | 0.30 | 0.90 | 5.7 | 0.042 | 0.014 | 0.003 | 0.0038 | — | — | — | — | — | — | — | — | — | — | 695 | Comparative steel |
| P | 0.41 | 1.52 | 2.3 | 0.040 | 0.012 | 0.003 | 0.0031 | — | — | — | — | — | — | — | — | — | — | 803 | Suitable steel |

*1 Underline means the value is outside the suitable range.

TABLE 2

| Sample No. | Steel type | M*2 (° C.) | First temperature range: Holding Temperature (° C.) | First temperature range: Holding time (second) | Cooling rate: First temperature range to 780° C.*3 (° C./s) | Cooling rate: Second temperature range*4 (° C./s) | Cooling rate: Third temperature range*5 (° C./s) | Cooling rate: Ms temperature to 300° C. (° C./s) | Plating*6 | Remarks |
|---|---|---|---|---|---|---|---|---|---|---|
| 1 | A | 366 | 870 | 150 | 15 | 14 | 6 | 6 | CR | Invention Example |
| 2 | A | 368 | 860 | 200 | 20 | 30 | 3 | 3 | CR | Invention Example |
| 3 | B | 263 | 785 | 180 | 5 | 10 | 25 | — | CR | Comparative Example |
| 4 | P | 285 | 840 | 350 | 3 | 10 | 1.0 | — | CR | Invention Example |
| 5 | C | 328 | 860 | 150 | 3 | 15 | 15 | 15 | CR | Comparative Example |
| 6 | C | 332 | 900 | 180 | 15 | 11 | 5 | 5 | GI | Invention Example |
| 7 | C | 332 | 870 | 220 | 20 | 20 | 3 | 3 | CR | Invention Example |
| 8 | D | 384 | 890 | 180 | 5 | 15 | 5 | 5 | CR | Invention Example |
| 9 | E | 364 | 900 | 60 | 4 | 12 | 5 | 5 | GA | Invention Example |
| 10 | F | 339 | 860 | 180 | 8 | 15 | 9 | 9 | GA | Invention Example |
| 11 | F | 338 | 850 | 300 | 5 | 10 | 7 | 7 | CR | Invention Example |
| 12 | F | 341 | 870 | 160 | 10 | 20 | 3 | 3 | CR | Invention Example |
| 13 | F | 340 | 900 | 100 | 15 | 50 | 4 | 4 | CR | Invention Example |
| 14 | F | 341 | 880 | 150 | 9 | 30 | 2 | 2 | GI | Invention Example |
| 15 | G | 405 | 880 | 180 | 10 | 20 | 4 | 4 | CR | Invention Example |
| 16 | H | 354 | 870 | 160 | 9 | 30 | 2 | 2 | CR | Invention Example |
| 17 | I | 373 | 890 | 90 | 13 | 40 | 3 | 3 | CR | Invention Example |
| 18 | J | 374 | 870 | 150 | 10 | 20 | 3 | 3 | CR | Invention Example |
| 19 | K | 369 | 910 | 70 | 5 | 12 | 4 | 4 | CR | Invention Example |
| 20 | L | 365 | 870 | 140 | 12 | 15 | 5 | 5 | CR | Invention Example |
| 21 | M | 378 | 900 | 100 | 10 | 15 | 3 | 3 | CR | Comparative Example |
| 22 | N | 245 | 870 | 160 | 10 | 20 | 3 | — | CR | Comparative Example |
| 23 | O | 198 | 870 | 100 | 5 | 30 | 3 | — | CR | Comparative Example |

*1Underline means the value is outside the suitable range.

*2Martensite start temperature (Ms temperature) obtained from an approximate expression: $M (° C.) = 540 - 361 \times \{[C\%]/(1 - [\alpha\%]/100)\} - 6 \times [Si\%] - 40 \times [Mn\%] + 30 \times [Al\%] - 20 \times [Cr\%] - 35 \times [V\%] - 10 \times [Mo\%] - 17 \times [Ni\%] - 10 \times [Cu\%]$

*3Average cooling rate in the range from first temperature range to 780° C.

*4Average cooling rate in the range from 780° C. to 550° C.

*5Average cooling rate in the range from Ms temperature to 150° C. (when M ≥ 300° C., average cooling rate in the range of 300° C. to 150° C.)

*6CR: no plating (cold-rolled steel sheet), GI: galvanizing, and GA: galvannealing The characteristics of the resultant steel sheets were evaluated by the following methods. To examine the microstructure of the steel sheets, two test pieces were cut from each of the steel sheets. One of the test pieces was polished without performing any treatment. The other of the test pieces was polished after heat treatment was performed at 200° C. for 2 hours. The polished surface was a section in the sheet thickness direction, the section being parallel to the rolling direction. By observing a steel microstructure of the polished surface with a scanning electron microscope (SEM) at a magnification of 3000×, the area ratio of each phase was measured to identify the phase structure of each crystal grain. The observation was performed for 10 fields and the area ratio was an average value of the 10 fields. The area ratios of autotempered martensite, ferrite, and bainite were obtained using the test pieces polished without performing any treatment. The area ratios of tempered martensite and retained austenite were obtained using the test pieces polished after heat treatment was performed at 200° C. for 2 hours. The test pieces polished after heat treatment was performed at 200° C. for 2 hours were prepared to differentiate untempered martensite from retained austenite in the SEM observation. In the SEM observation, it is difficult to differentiate untempered martensite from retained austenite. When martensite is tempered, an iron-based carbide is formed in the martensite. The iron-based carbide makes it possible to differentiate martensite from retained austenite. The heat treatment at 200° C. for 2 hours does not affect the phases other than martensite, that is, martensite can be tempered without changing the area ratio of each phase. As a result, martensite can be differentiated from retained austenite due to the formed iron-based carbide. By comparing the test pieces polished without performing any treatment to the test pieces polished after heat treatment was performed at 200° C. for 2 hours through SEM observation, it was confirmed that phases other than martensite were not changed.

The size and number of iron-based carbide grains included in autotempered martensite were measured through SEM observation. The test pieces were the same as those used in the microstructure observation. Obviously, the test pieces polished without performing any treatment were observed. The test pieces were observed at a magnification of 10000× to 30000× in accordance with the precipitation state and size of the iron-based carbide grains. The size of the iron-based carbide grains was evaluated using an average value of the major axis and minor axis of individual precipitates. The number of iron-based carbide grains each having a size of 5 nm or more and 0.5 μm or less was counted and thus the number of iron-based carbide grains per 1 $mm^2$ of autotempered martensite was calculated. The observation was performed for 5 to 20 fields. The mean number was calculated from the total number of all the fields of each sample, and the mean number was employed as the number (per 1 $mm^2$ of autotempered martensite) of iron-based carbide grains of each sample.

A tensile test was performed in accordance with JIS Z2241 using a JIS No. 5 test piece taken from the steel sheet in the rolling direction of the steel sheet. Tensile strength (TS), yield strength (YS), and total elongation (T. El) were measured. The product of the tensile strength and the total elongation (TS×T. El) was calculated to evaluate the balance between the strength and the elongation. When TS×T. El≥14500 MPa·%, the balance was determined to be satisfactory.

Stretch-flangeability was evaluated in compliance with The Japan Iron and Steel Federation Standard JFST 1001. The resulting steel sheet was cut into pieces each having a size of 100 mm×100 mm. A hole having a diameter of 10 mm was made in the piece by punching at a clearance of 12% of the thickness. A cone punch with a 60° apex was forced into the hole while the piece was fixed with a die having an inner diameter of 75 mm at a blank-holding pressure of 88.2 kN. The diameter of the hole was measured when a crack was initiated. The maximum hole-expanding ratio (%) was determined with Formula (2) to evaluate stretch-flangeability using the maximum hole-expanding ratio:

$$\text{Maximum hole-expanding ratio } \lambda(\%)=\{(D_f-D_0)/D_0\}\times 100 \quad (2)$$

where $D_f$ represents the hole diameter (mm) when a crack was initiated, and $D_0$ represents an initial hole diameter (mm). λ≥15% was determined to be satisfactory.

Table 3 shows the evaluation results.

TABLE 3

| Sample No. | Steel type | Area ratio (%) Auto-tempered martensite*2 | Ferrite | Bainite | Retained austenite | Number of iron-based carbide grains per 1 $mm^2$*3 | YS (MPa) | TS (MPa) | T · El (%) | TS × T · El (MPa · %) | λ (%) | TS × λ (MPa · %) | Remarks |
|---|---|---|---|---|---|---|---|---|---|---|---|---|---|
| 1 | A | 91 | 2 | 5 | 2 | $1\times10^6$ | 1221 | 1553 | 10.2 | 15841 | 36 | 55908 | Invention Example |
| 2 | A | 98 | 0 | 2 | 0 | $1\times10^6$ | 1037 | 1575 | 10.7 | 16853 | 45 | 70875 | Invention Example |
| 3 | B | 62 | 33 | 4 | 1 | $1\times10^3$ | 817 | 1521 | 7.5 | 11408 | 1 | 1521 | Comparative Example |
| 4 | P | 96 | 4 | 0 | 0 | $2\times10^6$ | 1048 | 2035 | 10.1 | 20554 | 15 | 30525 | Invention Example |
| 5 | C | 83 | 4 | 7 | 6 | $2\times10^4$ | 977 | 1546 | 14.5 | 22417 | 2 | 3092 | Comparative Example |
| 6 | C | 95 | 0 | 3 | 2 | $7\times10^4$ | 1383 | 1939 | 10.8 | 20941 | 15 | 29085 | Invention Example |
| 7 | C | 100 | 0 | 0 | 0 | $1\times10^5$ | 1161 | 1886 | 9.1 | 17163 | 17 | 32062 | Invention Example |
| 8 | D | 94 | 3 | 3 | 0 | $1\times10^6$ | 1045 | 1480 | 9.9 | 14652 | 46 | 68080 | Invention Example |
| 9 | E | 90 | 4 | 5 | 1 | $8\times10^5$ | 1055 | 1484 | 11.1 | 16472 | 48 | 71232 | Invention Example |
| 10 | F | 90 | 3 | 5 | 2 | $2\times10^5$ | 1023 | 1587 | 11.5 | 18251 | 22 | 34914 | Invention Example |
| 11 | F | 92 | 4 | 2 | 2 | $4\times10^5$ | 1005 | 1599 | 11.5 | 18389 | 25 | 39975 | Invention Example |
| 12 | F | 88 | 0 | 9 | 3 | $5\times10^5$ | 982 | 1548 | 11.2 | 17338 | 29 | 44892 | Invention Example |
| 13 | F | 94 | 2 | 4 | 0 | $5\times10^5$ | 974 | 1553 | 11.6 | 18015 | 34 | 52802 | Invention Example |
| 14 | F | 99 | 0 | 1 | 0 | $7\times10^5$ | 1020 | 1579 | 10.9 | 17211 | 41 | 64739 | Invention Example |
| 15 | G | 95 | 0 | 5 | 0 | $3\times10^6$ | 968 | 1484 | 10.6 | 15730 | 36 | 53424 | Invention Example |
| 16 | H | 98 | 0 | 2 | 0 | $8\times10^5$ | 1011 | 1555 | 11.2 | 17416 | 38 | 59090 | Invention Example |
| 17 | I | 93 | 2 | 5 | 1 | $5\times10^5$ | 980 | 1560 | 11.5 | 17940 | 32 | 49920 | Invention Example |
| 18 | J | 88 | 3 | 7 | 2 | $5\times10^5$ | 975 | 1542 | 11.5 | 17733 | 28 | 43176 | Invention Example |

TABLE 3-continued

| Sample No. | Steel type | Area ratio (%) Auto-tempered martensite*2 | Ferrite | Bainite | Retained austenite | Number of iron-based carbide grains per 1 mm²*3 | YS (MPa) | TS (MPa) | T · El (%) | TS × T · El (MPa · %) | λ (%) | TS × λ (MPa · %) | Remarks |
|---|---|---|---|---|---|---|---|---|---|---|---|---|---|
| 19 | K | 91 | 3 | 4 | 2 | $7 \times 10^5$ | 1021 | 1473 | 11.9 | 17529 | 40 | 58920 | Invention Example |
| 20 | L | 89 | 4 | 5 | 2 | $2 \times 10^6$ | 1210 | 1530 | 10.9 | 16677 | 35 | 53550 | Invention Example |
| 21 | M | 93 | 3 | 2 | 2 | $1 \times 10^7$ | 812 | 1314 | 10.8 | 14191 | 39 | 51246 | Comparative Example |
| 22 | N | 93 | 0 | 4 | 3 | $2 \times 10^4$ | 1265 | 2234 | 9.5 | 21223 | 0 | 0 | Comparative Example |
| 23 | O | 93 | 0 | 0 | 7 | $5 \times 10^3$ | 1084 | 2215 | 9.2 | 20378 | 0 | 0 | Comparative Example |

*1Underline means the value is outside the suitable range.
*2Autotempered martensites in Comparative Examples are imperfect.
*3The size of iron-based carbide grains is 5 nm or more and 0.5 μm or less.

As is clear from Table 3, our steel sheets have a tensile strength of 1400 MPa or higher, a value of TS×T. El≥14500 MPa·%, and a value of λ≥15% that represents stretch-flangeability and thus has both high strength and good workability.

In sample No. 3, a tensile strength of 1400 MPa or higher is satisfied, but an elongation and a λ value do not reach the intended values and thus the workability is poor. This is because the fraction of ferrite in the constituent microstructure is high and the amount of carbide included in the autotempered martensite is small. In sample No. 5, a tensile strength of 1400 MPa or higher and a TS×T. El of 14500 MPa·% or higher are satisfied, but a λ value does not reach the intended value and thus the workability is poor. The reason is as follows. Since the cooling rate in the third temperature range is high and autotempering does not sufficiently proceed, cracking from the interface between ferrite and martensite during the tensile test is suppressed. However, the amount of carbide in the martensite is small and the workability of martensite is insufficient around the end face that is subjected to severe deformation during the punching in the hole-expanding test, which easily causes cracks in the martensite.

It can be confirmed from the above description that steel sheets that include autotempered martensite sufficiently subjected to autotempering treatment such that the number of iron-based carbide grains in martensite is $5\times10^4$ or more per 1 mm² has both high strength and good workability.

Example 2

A slab to be formed into each of steel sheets having the compositions shown in steel types A, C, and F of Table 1 was heated to 1250° C. and subjected to finish hot-rolling at 880° C. The hot-rolled steel sheet was wound at 600° C., pickled, and cold-rolled at a reduction ratio of 65% to obtain a cold-rolled steel sheet having a thickness of 1.2 mm. The resultant cold-rolled steel sheet was subjected to heat treatment under the conditions shown in Table 4.

The resultant steel sheet was subjected to temper rolling at a reduction ratio (elongation ratio) of 0.3% regardless of the presence or absence of a coating.

The characteristics of the thus-obtained steel sheets were evaluated in the same manner as in Example 1. Table 5 shows the results.

In any of sample Nos. 24 to 27, suitable steel is used. However, it can be confirmed that since the cooling rate in heat treatment is outside our range, the steel microstructure and the number of iron-based carbide grains are outside our scope and, thus, high strength and good workability cannot be achieved.

TABLE 4

| Sample No. | Steel type | M*2 (° C.) | First temperature range: Holding Temperature (° C.) | First temperature range: Holding time (second) | Cooling rate: First temperature range to 780° C.*3 (° C./s) | Cooling rate: Second temperature range*4 (° C./s) | Cooling rate: Third temperature range*5 (° C./s) | Cooling rate: Ms temperature to 300° C. (° C./s) | Plating*6 | Remarks |
|---|---|---|---|---|---|---|---|---|---|---|
| 24 | A | 280 | 880 | 200 | 0.7 | 15 | 2 | — | CR | Comparative Example |
| 25 | A | 240 | 880 | 180 | 10 | 2 | 1.0 | — | CR | Comparative Example |
| 26 | F | 338 | 880 | 180 | 10 | 20 | 30 | 10 | CR | Comparative Example |
| 27 | C | 328 | 900 | 180 | 10 | 20 | 9 | 20 | CR | Comparative Example |

*1Underline means the value is outside the suitable range.
*2Martensite start temperature (Ms temperature) obtained from an approximate expression: M (° C.) = 540 − 361 × {[C %]/(1 − [α %]/100)} − 6 × [Si %] − 40 × [Mn %] + 30 × [Al %] − 20 × [Cr %] − 35 × [V %] − 10 × [Mo %] − 17 × [Ni %] − 10 × [Cu %]
*3Average cooling rate in the range from first temperature range to 780° C.
*4Average cooling rate in the range from 780° C. to 550° C.
*5Average cooling rate in the range from Ms temperature to 150° C. (when M ≥ 300° C., average cooling rate in the range of 300° C. to 150° C.)
*6CR: no plating (cold-rolled steel sheet), GI: galvanizing, and GA: galvannealing

TABLE 5

| Sample No. | Steel type | Area ratio (%) Auto-tempered martensite*2 | Ferrite | Bainite | Retained austenite | Number of iron-based carbide grains per 1 mm²*3 | YS (MPa) | TS (MPa) | T · El (%) | TS × T · El (MPa · %) | λ (%) | TS × λ (MPa · %) | Remarks |
|---|---|---|---|---|---|---|---|---|---|---|---|---|---|
| 24 | A | 26 | 65 | 5 | 4 | $2 \times 10^4$ | 667 | 1226 | 14.2 | 17409 | 5 | 6130 | Comparative Example |
| 25 | A | 15 | 70 | 11 | 4 | $3 \times 10^4$ | 805 | 1161 | 16.3 | 18924 | 20 | 23220 | Comparative Example |
| 26 | F | 95 | 2 | 3 | 0 | $1 \times 10^3$ | 1269 | 1831 | 10.7 | 19592 | 2 | 3662 | Comparative Example |
| 27 | C | 93 | 2 | 4 | 1 | $1 \times 10^3$ | 1371 | 1920 | 10.1 | 19392 | 2 | 3840 | Comparative Example |

*1Underline means the value is outside the suitable range.
*2In Comparative Examples, the area ratio of imperfect autotempered martensite is given and in Conventional Example, the area ratio of typical tempered martensite is given.
*3The size of iron-based carbide grains is 5 nm or more and 0.5 μm or less.

Example 3

A slab to be formed into each of steel sheets having the compositions shown in steel types P, C, and F of Table 1 was heated to 1250° C. and subjected to finish hot-rolling at 880° C. The hot-rolled steel sheet was wound at 600° C., pickled, and cold-rolled at a reduction ratio of 65% to obtain a cold-rolled steel sheet having a thickness of 1.2 mm. The resultant cold-rolled steel sheet was subjected to heat treatment under the conditions shown in Table 6. The resultant steel sheet was subjected to temper rolling at a reduction ratio (elongation ratio) of 0.3% regardless of the presence or absence of a coating. Sample Nos. 28, 30, and 32 in Table 6 are the same as sample Nos. 4, 6, and 11 in Table 2, respectively.

The characteristics of the thus-obtained steel sheets were evaluated in the same manner as in Example 1. Herein, the amount of autotempered martensite in which the number of precipitated iron-based carbide grains each having a size of 0.1 μm or more and 0.5 μm or less is $5\times10^2$, or less per 1 mm² in the entire autotempered martensite was obtained as follows.

As described above, the test pieces polished without performing any treatment were observed at a magnification of 10000× to 30000× using a SEM. The size of the iron-based carbide grains was evaluated using an average value of the major axis and minor axis of individual precipitates. The area ratio of autotempered martensite in which the iron-based carbide grains have a size of 0.1 μm or more and 0.5 μm or less was measured. The observation was performed for 5 to 20 fields.

Table 7 shows the results.

In sample No. 28, suitable steel having an M of less than 300° C. was cooled in the second temperature range and then cooled at a cooling rate of 1.0° C./s or higher and 10° C./s or lower in the third temperature range of Ms temperature to 150° C. to suitably control the precipitation of iron-based carbide grains in the autotempered martensite. Thus, it can be confirmed that such a steel sheet has good ductility with TS×T. El≥18000 MPa·% without significantly degrading stretch-flangeability.

In sample Nos. 30 and 32, suitable steels each having an M of 300° C. or higher were cooled in the second temperature range and then cooled at a cooling rate of 1.0° C./s or higher and 10° C./s or lower from 300° C. to 150° C. in the third temperature range of Ms temperature to 150° C. to suitably control the precipitation of iron-based carbide grains in the autotempered martensite. Thus, it can be confirmed that such steel sheets have good ductility with TS×T. El≥18000 MPa·% without significantly degrading stretch-flangeability.

TABLE 6

| Sample No. | Steel type | M*1 (° C.) | First temperature range: Holding Temperature (° C.) | First temperature range: Holding time (second) | Cooling rate: First temperature range to 780° C.*2 (° C./s) | Cooling rate: Second temperature range*3 (° C./s) | Cooling rate: Third temperature range*4 (° C./s) | Cooling rate: Ms temperature to 300° C. (° C./s) | Plating*5 | Remarks |
|---|---|---|---|---|---|---|---|---|---|---|
| 28 | P | 285 | 840 | 350 | 3 | 10 | 1.0 | — | CR | Invention Example |
| 29 | P | 285 | 840 | 350 | 3 | 8 | 0.5 | — | CR | Invention Example |
| 30 | C | 332 | 900 | 180 | 15 | 11 | 5 | 5 | GI | Invention Example |
| 31 | C | 332 | 900 | 180 | 15 | 11 | 0.8 | 0.8 | CR | Invention Example |
| 32 | F | 338 | 850 | 300 | 5 | 10 | 7 | 7 | CR | Invention Example |
| 33 | F | 338 | 850 | 300 | 5 | 10 | 0.4 | 0.4 | CR | Invention Example |

*1Martensite start temperature (Ms temperature) obtained from an approximate expression: M (° C.) = 540 − 361 × {[C %]/(1 − [α %]/100)} − 6 × [Si %] − 40 × [Mn %] + 30 × [Al %] − 20 × [Cr %] − 35 × [V %] − 10 × [Mo %] − 17 × [Ni %] − 10 × [Cu %]
*2Average cooling rate in the range from first temperature range to 780° C.
*3Average cooling rate in the range from 780° C. to 550° C.
*4Average cooling rate in the range from Ms temperature to 150° C. (when M ≥ 300° C., average cooling rate in the range of 300° C. to 150° C.)
*5CR: no plating (cold-rolled steel sheet), GI: galvanizing, and GA: galvannealing

TABLE 7

| Sample No. | Steel type | Area ratio (%) Auto-tempered martensite | Ferrite | Bainite | Retained austenite | Number of iron-based carbide grains (5 nm to 0.5 μm) per 1 mm$^2$ | Area ratio of autotempered martensite in which the number of precipitated iron-based carbide grains (0.1 μm to 0.5 μm) is $5 \times 10^2$ or less per 1 mm$^2$ to the entire autotempered martensite (%) |
|---|---|---|---|---|---|---|---|
| 28 | P | 96 | 4 | 0 | 0 | $2 \times 10^6$ | 6 |
| 29 | P | 96 | 4 | 0 | 0 | $3 \times 10^6$ | 0 |
| 30 | C | 95 | 0 | 3 | 2 | $7 \times 10^4$ | 15 |
| 31 | C | 95 | 0 | 3 | 2 | $9 \times 10^4$ | 2 |
| 32 | F | 92 | 4 | 2 | 2 | $4 \times 10^5$ | 12 |
| 33 | F | 92 | 4 | 2 | 2 | $7 \times 10^5$ | 0 |

| Sample No. | YS (MPa) | TS (MPa) | T · El (%) | λ (%) | TS × T · El (MPa · %) | TS × λ (MPa · %) | Remarks |
|---|---|---|---|---|---|---|---|
| 28 | 1048 | 2035 | 10.1 | 15 | 20554 | 30525 | Invention Example |
| 29 | 1051 | 1983 | 8.2 | 16 | 16261 | 31728 | Invention Example |
| 30 | 1383 | 1939 | 10.8 | 15 | 20941 | 29085 | Invention Example |
| 31 | 1320 | 1825 | 8.3 | 18 | 15148 | 32850 | Invention Example |
| 32 | 1005 | 1599 | 11.5 | 25 | 18389 | 39975 | Invention Example |
| 33 | 1025 | 1410 | 10.7 | 29 | 15087 | 40890 | Invention Example |

The invention claimed is:

1. A high strength steel sheet comprising a composition including, on a mass basis:

C: 0.12% or more and 0.50% or less;

Si: 2.0% or less;

Mn: 1.0% or more and 5.0% or less;

P: 0.1% or less;

S: 0.07% or less;

Al: 1.0% or less; and

N: 0.008% or less, with the balance Fe and incidental impurities, with a steel microstructure including on an area ratio basis, 80% or more of autotempered martensite, less than 5% of ferrite, 10% or less of bainite, and 5% or less of retained austenite; and the mean number of precipitated iron-based carbide grains each having a size of 5 nm or more and 0.5 μm or less and included in the autotempered martensite is $7 \times 10^4$ or more per 1mm$^2$ and a TS of 1400 MPa or more and a maximum hole-expanding ratio greater than or equal to 15%, wherein autotempered martensite microstructure includes a portion that contains a larger number of iron-based carbide grains having a size of 0.1 μm to 0.5 μm and a portion that contains a smaller number of iron-based carbide grains having a size of 0.1 μm 0.5 μm in a mixed manner such that the area ratio of autotempered martensite in which the number of precipitated iron-based carbide grains each having a size of 0.1 μm or more and 0.5 μm or less is $5 \times 10^2$ or less per 1 mm$^2$ to the entire autotempered martensite is 3% or more.

2. The high strength steel sheet according to claim 1, further comprising, on a mass basis, at least one element selected from:

Cr: 0.05% or more and 5.0% or less;

V: 0.005% or more and 1.0% or less; and

Mo: 0.005% or more and 0.5% or less.

3. The high strength steel sheet according to claim 1, further comprising, on a mass basis, at least one element selected from:

Ti: 0.01% or more and 0.1% or less;

Nb: 0.01% or more and 0.1% or less;

B: 0.0003% or more and 0.0050% or less;

Ni: 0.05% or more and 2.0% or less; and

Cu: 0.05% or more and 2.0% or less.

4. The high strength steel sheet according to claim 1, further comprising, on a mass basis, at least one element selected from:

Ca: 0.001% or more and 0.005% or less; and

REM: 0.001% or more and 0.005% or less.

5. The high strength steel sheet according to claim 1, wherein the area ratio of autotempered martensite in which the number of precipitated iron-based carbide grains each having a size of 0.1 μm or more and 0.5 μm or less is $5 \times 10^2$ or less per 1 mm$^2$ to the entire autotempered martensite is 3% or more.

6. The high strength steel sheet according to claim 1, wherein a galvanized layer is disposed on a surface of the steel sheet.

7. The high strength steel sheet according to claim 1, wherein a galvannealed layer is disposed on a surface of the steel sheet.

8. The high strength steel sheet according to claim 2, further comprising, on a mass basis, at least one element selected from:

Ti: 0.01% or more and 0.1% or less;

Nb: 0.01% or more and 0.1% or less;

B: 0.0003% or more and 0.0050% or less;

Ni: 0.05% or more and 2.0% or less; and

Cu: 0.05% or more and 2.0% or less.

9. The high strength steel sheet according to claim 2, further comprising, on a mass basis, at least one element selected from:

Ca: 0.001% or more and 0.005% or less; and

REM: 0.001% or more and 0.005% or less.

10. The high strength steel sheet according to claim 3, further comprising, on a mass basis, at least one element selected from:

Ca: 0.001% or more and 0.005% or less; and

REM: 0.001% or more and 0.005% or less.

11. The high strength steel sheet according to claim 2, wherein the area ratio of autotempered martensite in which the number of precipitated iron-based carbide grains each having a size of 0.1 μm or more and 0.5 μm or less is $5\times10^2$ or less per $1mm^2$ to the entire autotempered martensite is 3% or more.

12. The high strength steel sheet according to claim 3, wherein the area ratio of autotempered martensite in which the number of precipitated iron-based carbide grains each having a size of 0.1 μm or more and 0.5 μm or less is $5\times10^2$ or less per $1mm^2$ to the entire autotempered martensite is 3% or more.

13. The high strength steel sheet according to claim 4, wherein the area ratio of autotempered martensite in which the number of precipitated iron-based carbide grains each having a size of 0.1 μm or more and 0.5 μm or less is $5\times10^2$ or less per $1mm^2$ to the entire autotempered martensite is 3% or more.

14. The high strength steel sheet according to claim 2, wherein a galvanized layer is disposed on a surface of the steel sheet.

15. The high strength steel sheet according to claim 3, wherein a galvanized layer is disposed on a surface of the steel sheet.

16. The high strength steel sheet according to claim 4, wherein a galvanized layer is disposed on a surface of the steel sheet.

17. The high strength steel sheet according to claim 5, wherein a galvanized layer is disposed on a surface of the steel sheet.

18. The high strength steel sheet according to claim 2, wherein a galvannealed layer is disposed on a surface of the steel sheet.

* * * * *